US008646399B2

(12) United States Patent
MacKinnon

(10) Patent No.: US 8,646,399 B2
(45) Date of Patent: Feb. 11, 2014

(54) APPARATUS AND METHOD FOR ADAPTING A SUBSEA VEHICLE

(75) Inventor: Calum MacKinnon, Aberdeen (GB)

(73) Assignee: Subsea 7 Contracting (UK) Limited, Westhill (GB)

( * ) Notice: Subject to any disclaimer, the term of this patent is extended or adjusted under 35 U.S.C. 154(b) by 332 days.

(21) Appl. No.: 12/439,399

(22) PCT Filed: Aug. 29, 2007

(86) PCT No.: PCT/GB2007/050511

§ 371 (c)(1),
(2), (4) Date: Sep. 23, 2010

(87) PCT Pub. No.: WO2008/026007

PCT Pub. Date: Mar. 6, 2008

(65) Prior Publication Data

US 2011/0061583 A1 Mar. 17, 2011

(30) Foreign Application Priority Data

Aug. 31, 2006 (GB) ..... 0617125.0

(51) Int. Cl.

| | |
|---|---|
| ***B63G 8/00*** | (2006.01) |
| *B60L 11/00* | (2006.01) |
| *B63H 21/17* | (2006.01) |

(52) U.S. Cl.
USPC ..... 114/313; 440/6

(58) Field of Classification Search
USPC ..... 114/312, 313, 322, 328, 330, 332, 337; 440/3, 5, 6, 49, 66, 67, 76–79
See application file for complete search history.

(56) References Cited

U.S. PATENT DOCUMENTS

| | | | | |
|---|---|---|---|---|
| 3,838,654 | A * | 10/1974 | Haas | 440/5 |
| 4,821,665 | A * | 4/1989 | Matthias et al. | 114/222 |
| 5,995,882 | A * | 11/1999 | Patterson et al. | 701/21 |
| 6,167,831 | B1 | 1/2001 | Watt et al. | |
| 6,808,021 | B2 * | 10/2004 | Zimmerman et al. | 166/381 |
| 7,000,560 | B2 * | 2/2006 | Wingett et al. | 114/322 |
| 2002/0092458 | A1 | 7/2002 | Ku | |
| 2008/0041293 | A1 * | 2/2008 | Diorio et al. | 114/312 |

FOREIGN PATENT DOCUMENTS

| | | | |
|---|---|---|---|
| DE | 3128268 | A1 | 2/1983 |
| FR | 2862043 | A | 5/2005 |
| JP | 07 223589 | A | 8/1995 |
| WO | WO 91/13233 | A | 9/1991 |
| WO | WO 01/21476 | A | 3/2001 |
| WO | WO 01/21479 | A | 3/2001 |
| WO | WO 01/98140 | A | 12/2001 |
| WO | WO 03/059734 | A1 | 7/2003 |

* cited by examiner

*Primary Examiner* — Daniel Venne
(74) *Attorney, Agent, or Firm* — Levy & Grandinetti

(57) ABSTRACT

Disclosed are apparatuses and methods for the adaptation of a subsea vehicle, such as an ROV, and in particular a hydraulically powered construction or maintenance work ROV. In one embodiment the vehicle is provided with a module or modules which provide further propulsion means that have reduced noise at high speed in comparison to the vehicle's main propulsion means. The module or modules also optionally provide greater performance and decreased drag. An ROV adapted in such a way is therefore suitable for high speed survey work. In another embodiment a hydraulic ROV is adapted to enable it to be able to directly drive electrically powered tools.

11 Claims, 3 Drawing Sheets

APPARATUS AND METHOD FOR ADAPTING A SUBSEA VEHICLE

CROSS REFERENCE TO RELATED APPLICATION

This application claims the priority of GB 0617125.0 filed on 31 Aug. 2006, the disclosure of which is incorporated herein by reference for all purposes.

BACKGROUND TO THE INVENTION

This invention relates to subsea vehicles such as Remotely Operated Vehicles (ROVs) and in particular to apparatus and methods for the adaptation of ROVs for multi functional use.

Submersible Remotely Operated Vehicles are vehicles for underwater use which, as their name suggests, are unmanned and controlled by an operator at a remote location. ROVs have many uses such as surveying and scanning large swathes of ocean floor, to construction, deployment/recovery or maintenance of subsea installations. For surveying work, high speed, stability and a low noise signature are important, while for construction high speed is not required, with good maneuverability, strength and tooling being paramount. As these types of operations require quite different capabilities, ROVs come in different shapes and sizes, adapted specifically for different types of work.

Survey work, or metrology techniques undertaken by ROVs often rely on acoustic methods and survey ROVs in particular are often equipped with the necessary acoustic equipment for this type of work. However, in order for such techniques to be used successfully, background noise produced by the vehicle system, particularly the propulsion system should be kept to a minimum so as not to interfere with the sensitive acoustic signals. Consequently, as well as speed and agility, such vehicles require quiet propulsion systems in order to carry out acoustic surveying. The vehicle should be designed as a stable high speed/low noise system in order to maximise the quality of the survey data collected.

Hydraulic propulsion systems tend to be very noisy due to the large number of components in the pumps, motors valves and connecting pipework. Electrically driven propulsion systems are much quieter as they have less components. There are very few large construction ROV systems that have electric propulsion, most have noisy hydraulic propulsion systems.

ROVs designed for construction work tend to have hydraulically driven thrusters. The vehicles tend to be square in shape and their hydraulic thruster configuration not designed to propel the vessel at speed. Should these hydraulic systems be increased in power in order to increase speed, they become very noisy. As a result construction ROVs are unsuited for survey work. Conversely ROVs built for survey work are too long and have thrusters configured for forward speed and are therefore not equipped for intense construction work.

Furthermore, as construction ROVs are hydraulically powered, they only have hydraulic power available for thrusters and tooling, the umbilical having only a single set of power cores to provide power to drive the hydraulic power unit (HPU). This limits the type and size of tooling that can be mounted to the ROV. Said tooling tends also to be noisy and inefficient.

It would be desirable, therefore, to have a vehicle suitable for both high speed survey work and heavy construction work while achieving low noise performance. It would also be desirable to use electrically driven tooling on a vehicle designed only to use and provide hydraulic power.

SUMMARY OF THE INVENTION

In a first aspect of the invention there is provided apparatus for adapting a Remotely Operated Vehicle for at least a second function, said vehicle being originally adapted for at least a first function and having main propulsion means, said apparatus comprising a module for attachment to said Remotely Operated Vehicle, said module being provided with further propulsion means for propelling the vehicle more quietly than when propelled by said main propulsion means.

Send module may comprise a removable add-on thruster module. Said first function may be construction or maintenance work and said second function may be surveying work.

Said main propulsion means may be powered hydraulically. Said further propulsion means may comprise one or more electrically powered thrusters. However any propulsion means quieter than hydraulic thrusters when propelling the vehicle at speed would be suitable.

Said further propulsion means may be specifically configured for providing forward thrust Said module may also increase the performance and or speed capability of said Remotely Operated Vehicle.

Attachment of said module to the Remotely Operated Vehicle may be dedicated docking pin type interfaces. Said module preferably is designed for temporary attachment to said Remotely Operated Vehicle and may be removable or replaceable by another module.

Said Remotely Operated Vehicle may have an umbilical attached for the supply of electrical power from a first supply to said Remotely Operated Vehicle for generating a hydraulic supply, said umbilical being arranged to also supply electrical power from a second supply to said module. Said Remotely Operated Vehicle may be directly attached to said umbilical for obtaining said electrical power from said first supply, said module being arranged to obtain said electrical power via said vehicle. Alternatively said Remotely Operated Vehicle may be connected to the umbilical via a tether and associated tether management system. In this case, the tether would be used for the supply of electrical power from a first supply to said Remotely Operated Vehicle to be used to generate a hydraulic supply, said tether being arranged to also supply electrical power from a second supply to said module. Said second supply may also be arranged to supply at least one electrically operated tool. Said at least one electrically operable tool may be mounted to said vehicle or said module.

Said further (preferably electrical) propulsion means may be arranged to provide the main propulsion for the subsea vessel when said module is fitted while said main (usually hydraulic) propulsion means is used only for controlling heading and/or depth.

Said further propulsion means may be arranged to obtain their power from said Remotely Operated Vehicle, when in use.

Said module may further comprise buoyancy to maintain neutral buoyancy and stabilisers such as fins to aid stability.

Said module may be adapted for attachment at the rear of said Remotely Operated Vehicle. Said apparatus may further comprise a further module, such as a nose cone, to improve the hydrodynamics of said Remotely Operated Vehicle. Said nose cone may further comprise stabilizers, such as fins.

In a further aspect of the invention there is provided a Remotely Operated Vehicle fitted with the module(s) as described above.

In a further aspect of the invention there is provided a method for adapting a Remotely Operated Vehicle for at least a second function, said vessel being originally adapted for at least a first function comprising attaching a first module to said Remotely Operated Vehicle, said first module being provided with thrusters for propelling the vehicle more quietly than when propelled by said main propulsion means.

Said module may comprise a removable add-on thruster module.

Said Remotely Operated Vehicle may be one adapted specifically for construction or maintenance work.

Said further propulsion means may be specifically configured for providing forward thrust.

Said Recently Operated Vehicle may be supplied with electrical power, via an attached umbilical, from a first supply said electrical power from said first supply being used to generate a hydraulic supply and said first module may be supplied electrical power from a second supply via said umbilical. Said Recently Operated Vehicle may be directly attached to said umbilical for said supply of electric power from said first supply, said first module being supplied said electrical power from said second supply via said vehicle. Alternatively, said Recently Operated Vehicle may be connected to the umbilical via a tether and associated tether management system. In this case, the tether would be used for the supply of electrical power from a first supply to said Recently Operated Vehicle to be used to generate a hydraulic supply, said tether being arranged to also supply electrical power from a second supply to said module. Said second supply may also supply at least one electrically operated tool. Said at least one electrically operable tool may be mounted to said vehicle or said first module.

Said module may be attached to the rear of said Recently Operated Vehicle. Said method may further comprise the step of attaching a second module, such as a nose cone, to improve the hydrodynamics of said Recently Operated Vehicle when moving.

Said further propulsion means may, in use, obtain their power from said Recently Operated Vehicle.

Said further propulsion means may be electrically powered.

Said first module may further comprise buoyancy to maintain neutral buoyancy and stabilisers, such as fins, to aid stability.

Said method may further comprise the removal of said module(s) and replacing it/them with a tooling module, said tooling module using a power supply which was used by said first module.

In a further aspect of the invention there is provided a method for adapting a substantially hydraulically powered subsea vehicle to enable it to directly drive at least one electrically powered device, said vehicle normally only comprising a hydraulic power supply obtained from a main electrical supply, said method comprising providing an secondary electrical supply to said vehicle, both said main supply and secondary supply being supplied via an umbilical.

Said subsea vehicle may be a submersible Remotely Operated Vehicle.

Said secondary electrical supply may be provided for the direct driving of any electrically powered tooling mounted on or used by said subsea vehicle.

Said umbilical preferably is a dual train umbilical for delivering said main or first electrical supply and said secondary electrical supply, said main or first electrical supply and said secondary electrical supply being separate supplies. Said secondary electrical supply may be delivered directly to the vessel or via a tether and associated tether management system.

Said method may further comprise the fitting of a tooling module, such as an electrically powered water pump, said tooling module using said electrical supply. Said method may alternatively comprise the fitting of apparatus according to the first aspect of the invention, said electrical supply being used to power said further propulsion means.

In a further aspect of the invention there is provided a substantially hydraulically powered subsea vehicle adapted for the direct driving of at least one electrically powered device, said vehicle normally only comprising a hydraulic power supply obtained from a main electrical supply, said vehicle comprising a secondary electrical supply, both said main supply and secondary supply being arranged to be supplied via an umbilical.

Said subsea vehicle may be a submersible Remotely Operated Vehicle.

Said vehicle may have mounted to it electrically powered tooling, said secondary electrical supply being provided for the direct driving of said tooling.

Said umbilical preferably has a different core or set of cores for delivering said main electrical supply and said secondary electrical supply, said main electrical supply and said secondary electrical supply being separate supplies. Said secondary electrical supply may be arranged to be delivered directly to the vessel or via a tether and associated tether management system. In the latter case there may be provided a further core or set of cores in the umbilical to supply power to said tether management system.

Said vehicle may further comprise a tooling module fitted thereto said tooling module being arranged to use said electrical supply. Said tooling module may comprise an electrically powered water pump. Said vehicle may alternatively comprise the apparatus according to the first aspect of the invention fitted thereto, said electrical supply being used to power said further propulsion means.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
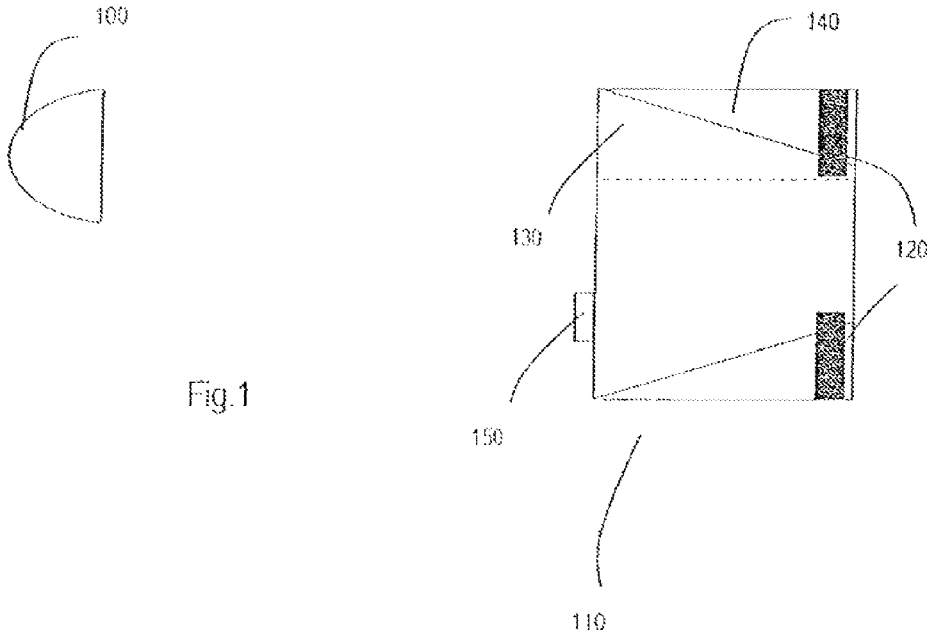
FIG. 1 shows the apparatus according to one embodiment of the invention; comprised of a Thruster Module and a Nose Cone Module.

FIG. 1 shows apparatus for converting a submersible Remotely Operated Vehicle (ROV) of a type particularly adapted for construction and maintenance work into one suitable for high speed, low noise survey work.

The apparatus comprises a nose cone 100 and a thruster module 110, these being removable add-on modules for an ROV. The thruster module 110 comprises electric thrusters 120, buoyancy material or floats 130, stability fins 140 and electrical connection means 150.

Figure 2:
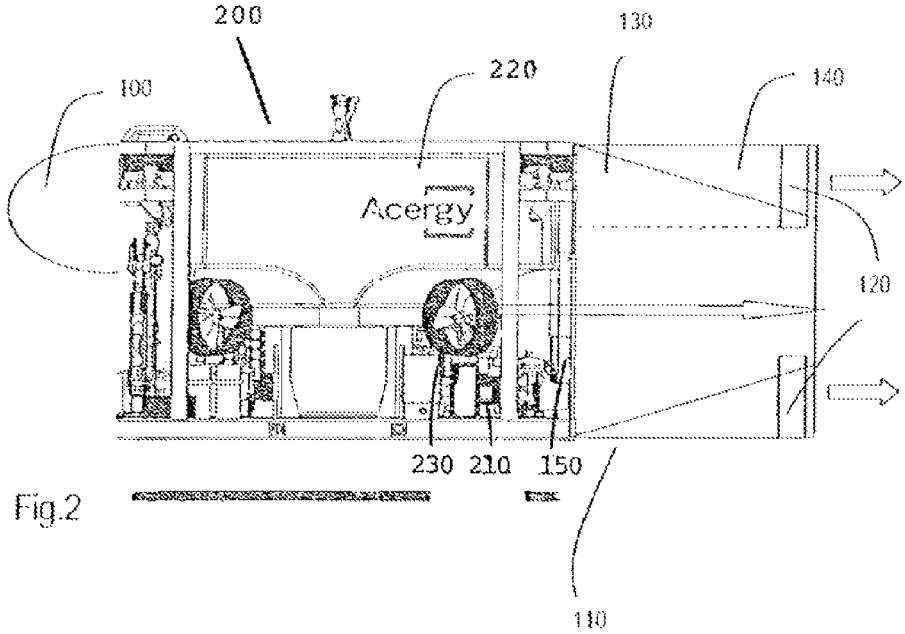
FIG. 2 shows the apparatus of FIG. 1 as attached to a Remotely Operated Vehicle

FIG. 2 shows the same apparatus in situ on ROV 200. The ROV 200 is of known construction type, being essentially very square in shape and being equipped with a large hydraulic motor of about 150 HP, buoyancy 220, and thrusters 230. This shape and thruster configuration makes it unsuitable for survey work unmodified.

The nose cone 100 is attached to the front of the ROV 200 and the thruster module 110 to the back. Attachment of the nose cone and module to the ROV may be by dedicated docking pin type interfaces although other means are envisaged. Said cone and module may be designed to be easily removable so that the ROV 200 is easily converted between both construction and survey modes of operation.

The electrical connection means 150 on the thruster module 110 connects or is connected to an electrical source on the ROV 200. The ROV will usually obtain this electrical source from its umbilical which also delivers the electrical source for its hydraulic power (the ROV being equipped with a Electro-Hydraulical power unit (HPU) for converting the electrical source into a hydraulic source). These two electrical sources are obtained from different supplies, and are delivered to the ROV/module via different cores in the umbilical. Such an umbilical, delivering two power sources, is known as a dual train umbilical.

The addition of the electric thrusters 120 result in there being a further 110 HP available to propel the vehicle through the water. Electrical thrusters are also relatively low noise devices compared to hydraulic driven thrusters, particularly when being used at full power, and therefore any power increase obtained is not at the expense of greatly increased noise. This is particularly important for a vehicle relying on acoustic methods for surveying. It is also a much more efficient means of propulsion.

In practice when carrying out high speed surveying operations, an ROV 200 suitably equipped with the thruster module 110 (and optional nose cone 100), has its hydraulic system pressure reduced to a minimum, its hydraulic thrusters being used only to provide automatic heading and depth control. All of the forward thrust is provided by the electrically driven rear mounted thruster module. Used in this way the ROV is not necessarily faster than if it was driven by its hydraulic thrusters alone, but is a lot quieter at high speed.

Furthermore, the addition of the nose cone 100 and rear fins 140 greatly improves the hydrodynamics and high speed stability of the ROV 200 as it is propelled through the water, turning the ROV 200 from a largely cuboid shape to a sleeker vehicle and more similar in design to dedicated survey ROVs or to an AUV. The buoyancy 130 also helps provide stability. The nose cone could also incorporate fins or control surfaces to improve stability at high speeds.

Figures 3A, 3B, 3C:
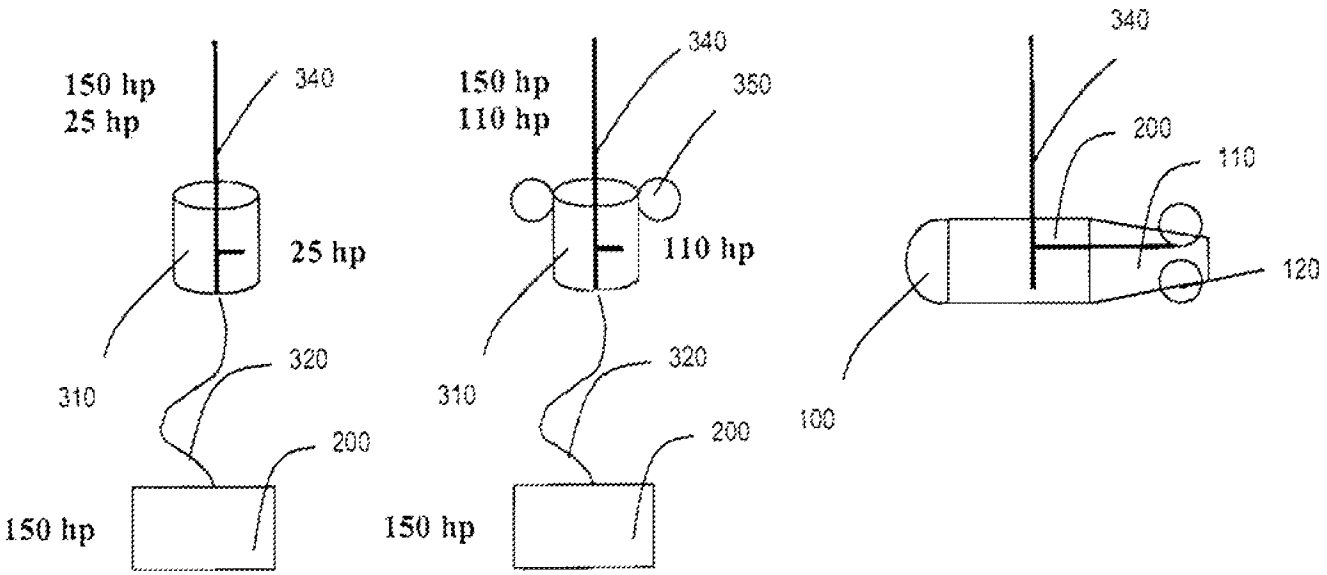
Fig.3b Prior Art
Fig.3a Prior Art
FIGS. 3*a*, 3*b*, 3*c* and 3*d* show the power distribution in, respectively, a standard configuration of ROV and tether management system, a known configuration of ROV with a thrustered tether management system, the arrangement depicted in FIG. 2 and a configuration for vehicle mounted electrically driven tooling according to a further embodiment of the invention.

FIGS. 3*a* and 3*b* show the power distribution for two prior art systems designed for construction/maintenance type work. FIG. 3*a* shows ROV 200 and Tether Management System (TMS) 310 connected by tether 320. The TMS is also connected to the surface via main umbilical 340. FIG. 3*b* shows much the same apparatus but with the addition of thrusters 350 attached to the TMS, this enables the TMS 310 to move independently from the ROV 200.

In the example of FIG. 3*a*, the umbilical 340 is a typical dual power train umbilical providing power to both the TMS 310 and ROV 200, via separate cores in the umbilical. The umbilical 340 provides 25 HP to the TMS 310 and 150 HP to the ROV 200 (via tether 320). In this configuration, the ROV 200 and TMS 310 are designed to be launched close to their worksite, and once there, the TMS 310 is designed to stay largely in one place while the ROV 200 undertakes its work.

In FIG. 3*b* the TMS 310 is equipped with thrusters providing 110 HP of thrust and is therefore capable of propelling itself. This enables the ROV 200 to be able to travel distances further than its tether would normally allow. The TMS can also be positioned better to support the ROV 200. The facility to have a large 110 HP power train in the umbilical 340 to enable the TMS 310 to be Thruster powered improves the operational capability of the system.

In the prior art examples shown in both FIGS. 3*a* and 3*b*, the dual power trains in the umbilical 340 are used to power hydraulic systems on the TMS 310 and ROV 200.

In FIG. 3*c* it can be seen that the 150 HP supply provided to power the hydraulic ROV 200 and the 110 HP supply provided to power the electric thrusters 120 is obtained directly from the main umbilical 340. The use of this dual power train to propel collectively the adapted ROV 200, 110, 100 (as opposed to the need to propel the TMS 310 separately as in the previous example), using both the ROV's hydraulic motor 210 and the thruster module's electric thrusters, enables both a hydraulic propulsion system and an electric propulsion system to be used in conjunction on the one ROV 200. This allows the main forward propulsion to be provided by the electrically driven thruster module 110, operating at low noise, while the heading and depth control can be provided by the hydraulic system. This power and thruster configuration will provide for the ability of the vehicle 200 to achieve much greater velocities, whilst maintaining low noise output (significantly quieter than a standard construction ROV), particularly in conjunction with the increased streamlining resulting from the nose cone 100 and fins 140.

The provision of a second 110 HP electrical supply on the vehicle also allows for the vehicle 200 to power a number of items of electrically powered equipment or tooling. Traditionally, any tooling mounted on the vehicle would be driven by the vehicle hydraulic system. This generally restricts the capacity of tooling that can be used as it would be limited by the hydraulic supply available from the vehicle. By having a 110 HP electrical supply available on the vehicle, electrically driven tooling can be used thus avoiding the traditional limitation imposed by the vehicle hydraulic system. This enables the vehicle 200 to handle much larger tooling systems than previously possible as well as significantly increasing efficiency (electrically powered tools are more efficient than hydraulically powered tools).

In the embodiment of FIG. 3*c* the electrical supply is provided directly to the vehicle 200 from the umbilical 340. As shown on FIG. 1, the thruster module 110 is able to source its power from the umbilical via the vehicle 200 and in particular electrical connector 150.

It is also envisaged that the 110 HP Thruster module could be replaced by an electrically driven 110 HP Tooling module. This could be done, for example, after completion of survey work and when construction is to begin again. An example of tooling modules which may be fitted is an electrically driven water pump. This could be used, for example, for dredging, pipeline pigging or pressure testing operations.

Figure 3D:
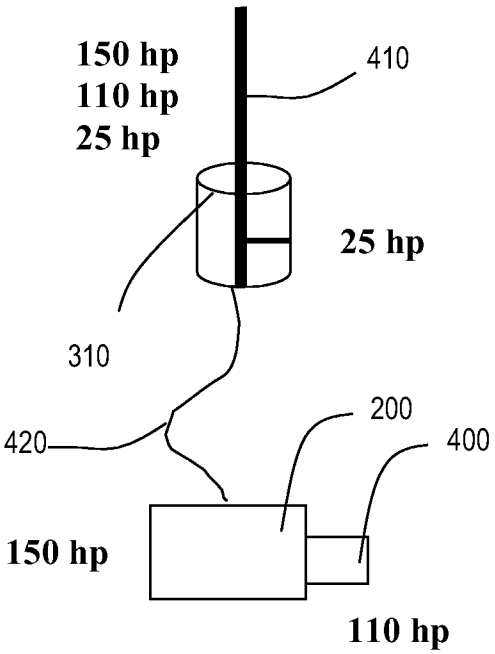

FIG. 3*d* shows an embodiment where the thruster module has been replaced by tooling module 400. In this embodiment the ROV is connected to the umbilical 410 via a tether 420 and TMS 310. In this case the umbilical 410 is provided with 3 power trains, one for the TMS 310 (25 Hp), one for the hydraulic ROV 200 (150 HP) and one for the ROV mounted module's 110 HP supply. In the configuration shown the TMS supplies power to the 150 HP hydraulic power unit on the ROV while also providing the 110 HP electrical supply to the ROV and module respectively, via a single tether. Consequently, there is provided a 110 HP supply on the vehicle available for direct electrical driving of tooling.

The foregoing examples are for illustration only and it should be understood that other embodiments and variations are envisaged without departing from the spirit and scope of the invention. For example the power figures quoted are only examples and the skilled person will realise that other power distribution arrangements are possible.

The invention claimed is:

1. A remotely operated vehicle system comprising:

a remotely operated vehicle for subsea operation, the remotely operated vehicle comprises an electrical power supply and a hydraulic motor, and a removable add-on thruster module, the removable add-on thruster module comprises one or more electrically powered thrusters, wherein the remotely operated vehicle and the removable add-on thruster module are releasably attached with each other, and wherein when the removable add-on thruster module is attached to the remotely operated vehicle, the remotely operated vehicle provides buoyancy, thrusters, and electrical power to the one or more electrically powered thrusters of the removable add-on thruster module from the electrical power supply of the remotely operated vehicle and the one or more electrically powered thrusters of the removable add-on thruster module are operative to provide further propulsion to the remotely operated vehicle.

2. A remotely operated vehicle system as claimed in claim 1 wherein removable add-on thruster module is attachable on a back part of the remotely operated vehicle and the one or more electrically powered thrusters provide forward thrust.

3. A remotely operated vehicle system as claimed in claim 1 further comprising an umbilical connected to said remotely operated vehicle, wherein said umbilical supplies electrical power to the removable add-on thruster module and also to said remotely operated vehicle to power the hydraulic motor.

4. A remotely operated vehicle system as claimed in claim 1 wherein, when said removable add-on thruster module is attached to the remotely operated vehicle, the one or more electrically powered thrusters provide a main propulsion for the remotely operated vehicle whereas the hydraulic motor controls heading and/or depth.

5. A remotely operated vehicle system as claimed in claim 1 wherein said removable add-on thruster module further comprises stabilizers to aid stability of the remotely operated vehicle.

6. A remotely operated vehicle system as claimed in claim 1 further comprising a nose cone provided as a further removable add-on module for releasable attachment to the remotely operated vehicle to improve hydrodynamics of said remotely operated vehicle.

7. A method of adapting a remotely operated vehicle for subsea operation to modify the remotely operated vehicle, wherein the remotely operated vehicle comprises an electrical power supply and a hydraulic motor, the method comprising:

attaching a removable add-on thruster module comprising one or more further electrically powered thrusters for further propulsion to the remotely operated vehicle;

providing from the remotely operated vehicle, buoyancy, thrusters, and electrical power to the one or more electrically powered thrusters of the removable add-on thruster module from the electrical power supply of the remotely operated vehicle; and propelling the remotely operated vehicle with the one or more further electrically powered thrusters of the removable add-on thruster module.

8. A method as claimed in claim 7 further comprising attaching the removable add-on thruster module to a back of the remotely operated vehicle, and providing forward thrust with the electrically powered thrusters when the electrically powered thrusters are propelling the remotely operated vehicle.

9. A method as claimed in claim 7 comprising converting the remotely operated vehicle from a construction or maintenance work configuration to a surveying work configuration by the addition of the removable add-on thruster module and a nose cone.

10. A method as claimed in claim 7 further comprising supplying electrical power to the remotely operated vehicle by an umbilical attached to the remotely operated vehicle from a first supply, and by using said supplied electrical power to power the hydraulic motor of the remotely operated vehicle and to supply electrical power to the removable add-on thruster module.

11. A method as claimed in claim 7 further comprising releasably attaching a nose cone to the remotely operated vehicle to improve hydrodynamics of said remotely operated vehicle when moving.

* * * * *